US007399737B2

(12) United States Patent
Hazelton et al.

(10) Patent No.: US 7,399,737 B2
(45) Date of Patent: Jul. 15, 2008

(54) LUBE ADDITIVES

(75) Inventors: Ronald Lewis Hazelton, Southport, NC (US); Periagaram Srinivasan Ravishankar, Kingwood, TX (US); Kirk Alan Nass, San Francisco, CA (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 164 days.

(21) Appl. No.: 11/151,324

(22) Filed: Jun. 13, 2005

(65) Prior Publication Data

US 2006/0281647 A1 Dec. 14, 2006

(51) Int. Cl.
*C10M 143/04* (2006.01)
*C10M 149/06* (2006.01)

(52) U.S. Cl. ..... 508/591; 508/506; 508/287

(58) Field of Classification Search ..... 508/591, 508/506, 287
See application file for complete search history.

(56) References Cited

U.S. PATENT DOCUMENTS

| | | | | |
|---|---|---|---|---|
| 5,151,204 A | | 9/1992 | Struglinski | 252/52 R |
| 5,427,702 A | * | 6/1995 | Chung et al. | 508/221 |

FOREIGN PATENT DOCUMENTS

| | | |
|---|---|---|
| EP | 495 099 | 7/1992 |
| EP | 608 369 | 8/1994 |
| EP | 632 066 | 1/1995 |
| WO | WO 97/32946 | 9/1997 |
| WO | WO 99/10422 | 3/1999 |
| WO | WO 02/46251 | 6/2002 |

* cited by examiner

*Primary Examiner*—Robert D. Harlan

(57) ABSTRACT

Lube formulations and concentrates are disclosed herein. The formulations comprise copolymers of ethylene and propylene.

8 Claims, 2 Drawing Sheets

LUBE ADDITIVES

FIELD OF INVENTION

The invention relates to ethylene-alpha-olefin copolymers (OCP) for use as lube additives in lube oil viscosity modification and to lube concentrates and lubricant formulations containing such OCP's.

BACKGROUND OF INVENTION

Lubricant oil formulations generally contain polymeric Viscosity Index ("VI") improving components which modify the rheological behavior to increase the lubricant viscosity and promote a more constant viscosity over the range of temperatures over which the lubricant is used in, for example, automotive engines. Ethylene-alpha-olefin copolymers (OCPs) have been used to increase viscosity at elevated temperatures. Lengths of ethylene derived units are believed to be instrumental. To maintain the OCP in solution, amounts of propylene-derived units are incorporated into the polymer chain to hinder crystallization of the OCP. Higher ethylene-content copolymers efficiently promote oil thickening, shear stability and low temperature viscometrics, while lower ethylene-content copolymers are added for the purpose of lowering the oil pour point or the co-crystallization with a wax component of the oil.

It is known that narrow molecular weight distribution is desirable for good shear stability and to avoid the inclusion of polymer chains that are either to long or too short to have the desired viscometric effect. Presence of long chain branches has been believed to be undesirable given the potential effect of broadening the molecular weight distribution.

It is known that certain polymerization techniques and polymerization catalysts can be combined to provide levels of detectable long chain branching (LCB), it is also known that diene and free radical modification or polymers can introduce LCB (see WO 99/10422). LCB is defined herein as any branch formed in the polymer that is not derived from the short chain branching (SCB) due to comonomer incorporation. Thus LCB excludes the methyl branching due to propylene insertion or the hexyl branching due to octene-1 insertion. $^{13}C$ NMR cannot determine the overall length of the LCB chain. However while SCB impacts density and crystallization behavior, by itself SCB does not influence viscous flow behavior which is substantially Newtonian. Non-SCB branching generally leads to distortion of viscous flow behavior, which can be detected by a variety of techniques, including rheology measurements, shear sensitivity under different shear stresses as in MI ratios; internal energy of activation of flow etc. The presence of LCB may also become apparent from other aspects of the molten polymer mass: melt tension, die swell, and melt strength. Further, the presence of LCB may be determined from comparisons of behavior when dissolved in a solvent to determine viscosity as such or the molecular weight in a GPC test. Examples of suitable polymerization techniques are provided in EP 495 099 and EP 608 369.

U.S. Pat. No. 5,151,204 discloses the use of metallocenes in preparing Viscosity Index Improvers but there is no indication of the presence of or level of LCB. EP 632 066 uses a specific metallocene catalyst and the presence of LCB is not disclosed. WO 02/46251 discloses the use of series reactors to produce reactor blends with improved storage flexibility. An oleaginous composition containing a viscosity modifying amount of a linear ethylene polymer which has (a) melt flow ratio $I_{10}/I_2$ at least 5.63, (b) mol. wt. distribution Mw/Mn defined by $Mw/Mn \geqq (I_{10}/I_2)-4.63$ and (c) a critical shear rate at onset of surface melt fracture of at least 50% greater than the critical shear rate at onset of surface melt fracture of a linear olefin polymer having a similar $I_2$ and Mw/Mn is disclosed in WO 97/32946.

The parameters (a) to (c) are indicative of the presence of LCB. WO9732946 does not exemplify the use of propylene-derived polymers and the effect of improving soot dispersion.

All the publications mentioned herein are incorporated for US legal purposes.

It is among the objects of the invention to provide an OCP which not only has a viscosity modifying effect but also helps to improve soot dispersion in the vehicle crankcase oil.

SUMMARY OF INVENTION

The invention uses LCB in the OCP to improve soot dispersion. In one aspect the invention relates to the use or the process of using, in the operation of an internal combustion engine, an OCP comprising a copolymer of ethylene and propylene having from 40 to 80 wt % of ethylene derived units and an ML (1+4@125° C.) of from 2 to 30 and an Mw/Mn (GPC/DRI) of from 1.8 to 2.5 and an $I_{21}/I_2$ of 20 to 400, preferably up to 200 in improving soot dispersion. The OCP may be traded as a solid for solubilizing into oil by lube oil formulators, as an oil concentrate for blending and dilution by lube oil formulators; or may be traded as part of a complete crankcase lube oil formula. Preferred aspects of the invention as described below apply to all forms of the invention.

DETAILED DESCRIPTION

Figure 1:
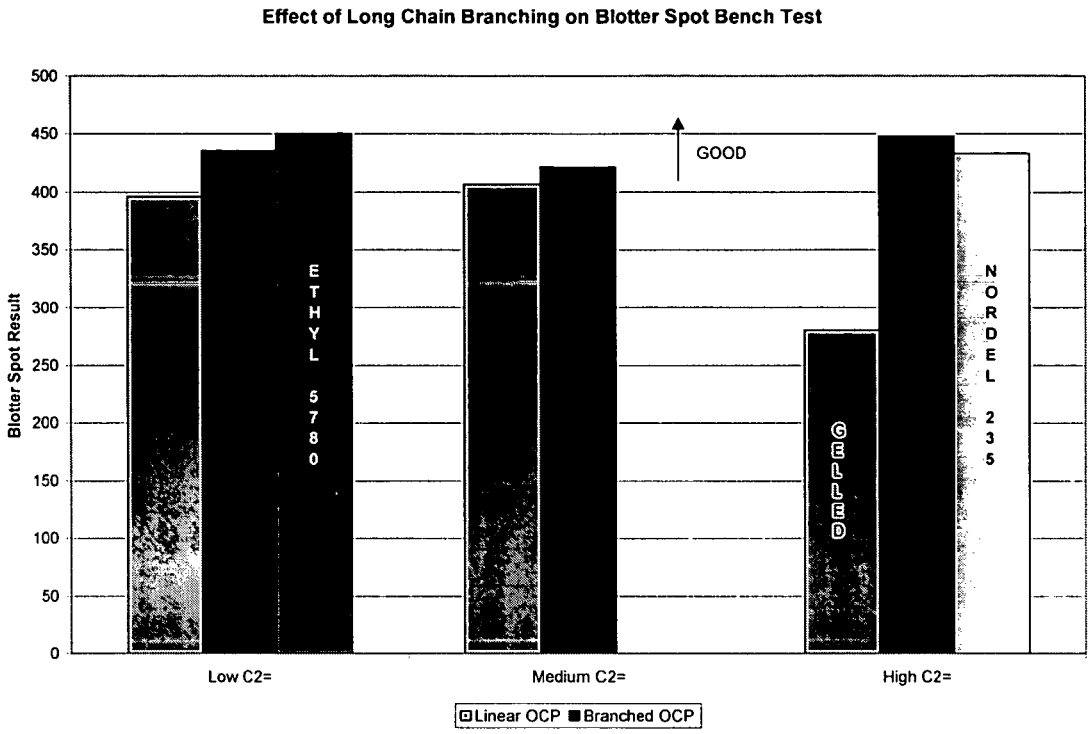
FIG. 1 is a graph depicting the effect of long chain branching of OCP's on blotter spot bench test in at least one aspect of the present invention.

In one embodiment the polymer contains no diene derived units and the comonomers are evenly spaced along the polymer chain as indicated by a reactivity ratio as determined by NMR of less than 1. The presence of LCB can be reflected in a high shear sensitivity. Preferably the $I_{21}/I_2$ is from 30 to 60. The OCP has a bimodal composition distribution, and preferably is a reactor blend as described in WO0246251.

The OCP may be used without any grafting or chemical modification to enhance its ability to act as a dispersant. Alternatively, the OCP may be grafted with a functionalizing reagent such as maleic anhydride, and optionally an amine.

The presence of LCB may also be demonstrated by a GPC derived measurement, the Branching Index as described herein. Suitably then the OCP comprises a copolymer of ethylene and propylene having from 40 to 80 wt % of ethylene derived units and an ML (1+4@125) of from 2 to 30 and an Mw/Mn (GPC/DRI) of from 1.8 to 2.5 and a Branching Index as defined herein of greater than 0.5, preferably greater than 0.7. This may be applicable to higher levels of LCB whose formation may be aided by the presence of diene derived units in polymerization.

Controlling Extent of LCB Formation by Incorporation Using of Reactive Chain Ends One route towards making the polymers having LCB is to promote the incorporation of polymer chains having olefinically polymerizable chain ends creating a beta-hydride chain termination reaction as occurs with metallocene based catalysts. Accordingly the OCP may be made by a continuous polymerization process for preparing a random ethylene interpolymer which comprises the steps of:

(A) polymerizing ethylene, and propylene under continuous random polymerization conditions in the presence of single site catalyst system employing an ionic activator having cyclic ligands shielding a central charge bearing atom, at a temperature of from 50° C. to 250° C. at a high conversion of ethylene, preferably from 80 to 99% and a high propylene conversion, preferably of from 20 to 80%; and (B) devolatilizing the polymer.

Generally speaking, $I_{21}/I_2$ values are a function of MI and at low MI value high values of MIR ($I_{21}/I_2$) are possible. The comonomer conversion may be less than 60% and the MIR ($I_{21}/I_2$) may be less than 180.

High activities can be achieved with lower catalyst residues in the final polymer product. In the process increased conversion helps attain the desired increased $I_{21}/I_2$ attributable to the presence of long chain branches.

The polymerization may be performed adiabatically using a catalyst system including a hafnocene having two cyclopentadienyl groups connected by a bridging structure, preferably a single atom bridge. The ionic activator preferably has at least two polycyclic ligands, especially at least partly fluorinated.

It may be advantageous to maximize the reactor temperature and substantially eliminate the use of transfer agent such as hydrogen. The high temperature may improve the amount of LCB through better incorporation of vinyl terminated polymer chains formed earlier in the polymerization process. Chain transfer agents such as hydrogen can influence the termination mechanism to reduce the amount of vinyl unsaturation and discourage LCB formation. In such circumstances the heat of the polymerization reaction may raise the temperature by at least 100° C. between the feed for the continuous polymerization and the effluent to be devolatilized.

The polymerization may be performed in a single reactor such as a single continuous stirred tank reactor or the polymerization may be performed in series continuous stirred tank reactors to provide a composition distribution.

The preferred process conditions, including catalyst selection, may be obtained using, as the single site catalyst, a transition metal complex of a Group IV metal, preferably Zr or Hf, most preferably Hf. A level of single site residue as measured by the content of transition metal may be reached which is less than 2 ppm (parts per million), preferably less than 1 ppm as determined by ICP.

Low levels of catalyst residue may remain in the polymer. The polymerization conditions can be selected to provide a high conversion of the monomers in solution, so favoring the incorporation of vinyl terminated macromers, which thus go on to form LCB's. High conversions reduce the cost for recycling unconsumed monomer.

The LCB content may be indirectly measured by the melt index ratio, MIR, measured at MIR ($I_{21}/I_2$). Highly branched products have high MIR ($I_{21}/I_2$) and linear products have low MIR ($I_{21}/I_2$). Whereas substantially linear products may have moderate MIR ($I_{21}/I_2$) values around 12 to 17 as described in EP608369, and whereas typical commercial plastomers produced in solution may have MIR values that are somewhat above that, the polymer products of this invention have MIR values around 40 to 60 and even as high as 80.

The level of long chain branching depends on the selection of the transition metal component and some process conditions such as temperature and the extent to which the monomer present is converted.

The choice of transition metal component and NCA may influence the chain growth and molecular weight. If the catalyst system and process conditions are selected to optimize molecular weight, higher operating temperature may be used to achieve a given molecular weight. A higher operating temperature may increase the activity and/or permit higher polymer concentrations in the reactor and so higher productivity in terms of weight of polymer produced per unit time in a given size plant. The higher process temperature aids the incorporation of vinyl terminated macromers.

The level of branching is also influenced by the extent to which monomer is converted into polymer. At high conversions, where little monomer remains in the solvent, conditions are such that vinyl terminated chains are incorporated into the growing chains more frequently, resulting in higher levels of LCB. Catalyst levels may be adjusted to influence the level of conversion as desired.

Bridged bis-ligand metallocene structures can provide a catalytic site, which encourages incorporation of LCB. Smaller propylene comonomers can be incorporated more easily as well. By using catalyst systems that combine a propensity for providing a high molecular weight with high comonomer incorporation and avoiding or reducing the amount of higher α-olefins used as comonomer, it is possible to extend the operating envelope for polymerization to regions of high temperature and/or high monomer conversion to favor LCB formation so as to give MIR ($I_{21}/I_2$) in excess of 30 with catalyst activities based on grams of polymer produced per gram of transition metal compound consumed for continuous processes in excess of 200,000, possibly 400,000, or even above 600,000 for the target range of molecular weight.

It is most preferred to use a NCA whose charge bearing atom or atoms, especially boron or aluminum, are shielded by halogenated, especially perfluorinated, cyclic radicals, and especially polycyclic radical such as biphenyl and/or naphthyl radicals. Most preferably the NCA is a borate precursor having a boron atom shielded by four, perfluorinated polycyclic radicals. Selected metallocene-NCA combinations may assist in preserving higher molecular weights and/or higher operating temperatures. Thus they may be among the preferred catalyst for the interpolymers of the invention. By operating the continuous process in solution at unusually high process temperatures and/or monomer conversions, surprisingly high levels of LCB may be achieved.

Controlling Extent of LCB Formation by Chain Growth Using Reactive Dienes

Another way of introducing controlled levels of LCB is to use dienes which have two functionalities participating in the polymerization process. In this case vanadium based catalysts activated by aluminum alkyls or aluminum chlorides that are conventionally employed in the production of EP rubbers may be used, as well as metallocenes.

WO99/00434 describes combining ENB, VNB and specific branching inhibitors to produce EPDM with reduced branching. The ENB derived units are present in amounts well in excess of the amount of VNB. The spectrum of LCB and MWD variations that can be obtained are influenced by a branching modifier.

The polymerization process may comprise a solution polymerizing ethylene, propylene and diene having two polymerizable double bonds and reacting ethylene, higher alpha-olefin comonomer and diene comprising vinyl norbornene in the presence of a vanadium based catalyst system. As described in WO04/000900 published on 31 Dec. 2003, this may be preceded by a preliminary first step polymerization of ethylene, propylene and optionally one or more dienes to produce a polymer composition comprising from 0 to less than 1 mol % of diene having one or two polymerizable double bonds, in the presence of the vanadium based catalyst system. When operating in two step mode, the amount of vinyl norbornene added in the second step may be more than 50% of the total diene added in the first and second step combined. The recovered product has from 0.1 to 1 mol % of units derived from vinyl norbornene and a total of no more than 5 mol % diene derived units, from 50 mol % to 90 mol % ethylene derived units and a balance of propylene derived units. The degree of LCB may be expressed as a branching index of greater than 0.5, preferably greater than 0.7, with an upper limit of 0.97, more preferably 0.95, and more preferably 0.90. The molecular weight may be expressed as Mooney viscosity.

The diene having two polymerizable double bonds apart from VNB may be selected from the group consisting of: 1,4-hexadiene, 1,6 octadiene, 5-methyl-1,4-hexadiene, 3,7-dimethyl-1,6-octadiene, dicyclopentadiene (DCPD), norbornadiene, 5-vinyl-2-norbornene (VNB), and combinations thereof. The amount of diene having two polymerizable double bonds in the polymer product may vary from 0.2 to 2 mol %, preferably from 0.1 to 1 mol %, more preferably from 0.1 to 0.5 mol %. Other dienes may be added during the polymerization process. All ranges disclosed herein are inclusive unless otherwise noted.

The relative degree of branching in ethylene, alpha-olefin, diene monomer elastomeric polymers is determined using a branching index factor (BI). Calculating this factor requires a series of three laboratory measurements of polymer properties in solutions as disclosed in VerStrate, Gary, "Ethylene-Propylene Elastomers", Encyclopedia of Polymer science and Engineering, 6, $2^{nd}$ edition (1986). These are:

$M_{w,\,GPC\,LALLS}$, weight average molecular weight measured using a low angle laser light scattering (LALLS) technique in combination with Gel Permeation Chromatography (GPC) (ii) $M_{w,\,DRI}$, weight average molecular weight, and $M_{v,\,DRI}$, viscosity average molecular weight, using a differential refractive index (DRI) detector in combination with GPC and (iii) intrinsic viscosity (IV) measured in decalin at 135° C. The first two measurements (i and ii) are obtained in a GPC using a filtered dilute solution of the polymer in trichlorobenzene.

An average branching index (i.e., branching index as used herein) is defined as:

$$BI = \frac{M_{v,br} \times M_{w,DRI}}{M_{w,GPC\ LALLS} \times M_{vGPC\ DRI}}$$

where, $M_{v,br}=(IV/k)^{1/a}$; and 'a' is the Mark-Houwink constant (=0.759 for ethylene, propylene diene elastomeric polymers in decalin at 135° C.). From equation (1) it follows that the branching index for a linear polymer is 1.0. For branched polymers, the extent of branching is defined relative to the linear polymer. Since at a constant number average molecular weight, $M_n$, $(M_W)_{branch}>(M_W)_{linear}$, BI for branched polymers is less than 1.0 and a smaller BI value denotes a higher level of branching. In place of measuring IV in decalin, it is also acceptable to measure IV using a viscosity detector in tandem with DRI and LALLS detectors in the so-called GPC-3D instrument. In this case, 'k' and 'a' values appropriate for the GPC solvent should be used in the equation above.

Controlling Extent of LCB Formation by Free-Radical Processes

A further option for introducing controlled levels of LCB is through free-radical modification, such as with peroxides. Irradiation may also be considered. WO97/32922 describes possible options for performing such processes and quantifying the resulting polymer properties. Linear heterogeneously branched polyethylene may be made through use of irradiation. Free radical modifcation can help provide cost effective modification of polymer such that the resultant modified polymer has higher zero shear viscosity, low high shear viscosities, improved melt flow properties, improved critical shear rate at onset of surface melt fracture, improved critical shear stress at onset of gross melt fracture, improved rheological processing index (PI).

Such polymers may be obtained from a rheology-modified ethylene copolymer having less than 0.5 wt percent gel as measured via ASTM D2765, Procedure A, a narrow Composition Distribution Branch Index (CBDI) of greater than 50 percent and a narrow molecular weight distribution less than 4.0.

Details of Invention

In a particular embodiment the OCP is used as a Viscosity Index ("VI") improver for a lubricating oil composition. Preferably the OCP has solubility in base oil of at least 10 wt %. From 0.001 to 49 wt % of this composition is incorporated into a base oil, such as a lubricating oil or a hydrocarbon fuel, depending upon whether the desired product is a finished product or an additive concentrate. The amount of the VI improver used is an amount which is effective to improve or modify the Viscosity Index of the base oil, i.e., a viscosity improving effective amount. Generally, this amount is from 0.001 to 20 wt % for a finished product (e.g., a fully formulated lubricating oil composition), with alternative lower limits of 0.01%, 0.1% or 1%, and alternative upper limits of 15% or 10%, in other embodiments. Ranges of VI Improver concentration from any of the recited lower limits to any of the recited upper limits are within the scope of the present invention, and one skilled in the art can readily determine the appropriate concentration range based upon the ultimate solution properties.

Base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like produced from natural feedstock.

The lubricating oils to which the products of this invention can be added include not only hydrocarbon oils derived from petroleum, but also include synthetic lubricating oils such as esters of dibasic acids; complex esters made by esterification of monobasic acids, polyglycols, dibasic acids and alcohols; polyolefin oils, etc. Thus, the VI Improver compositions of the present invention may be suitably incorporated into synthetic base oils such as alkyl esters of dicarboxylic acids, polyglycols and alcohols; polyalpha-olefins; polybutenes; alkyl benzenes; organic esters of phosphoric acids; polysilicone oils; etc.

The VI compositions of the present invention can also be utilized in a concentrate form, such as from 1 wt % to 49 wt. % in oil, e.g., mineral lubricating oil, for ease of handling, and may be prepared in this form by carrying out the reaction of the invention in oil as previously described.

The above oil compositions may optionally contain other conventional additives, such as, for example, pour point depressants, antiwear agents, antioxidants, other Viscosity Index Improvers, dispersants, corrosion inhibitors, antifoaming agents, detergents, rust inhibitors, friction modifiers, and the like.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at a temperature in the range of 66 to 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service, as evidenced by the products of oxidation such as sludge and varnish-like deposits on the metal surfaces, and by viscosity growth. Such oxidation inhibitors include alkaline earth metal salts of alkylphenolthioesters having $C_5$ to $C_{12}$ alkyl side chains, e.g., calcium nonylphenate sulfide, barium octylphenate sulfide, dioctylphenylamine, phenylalphanaphthylamine, phospho-sulfurized or sulfurized hydrocarbons, etc.

Other oxidation inhibitors or antioxidants useful in this invention include oil-soluble copper compounds, such as described in U.S. Pat. No. 5,068,047, the disclosure of which is incorporated herein for purposes of U.S. patent practice.

Friction modifiers serve to impart the proper friction characteristics to lubricating oil compositions such as automatic transmission fluids. Representative examples of suitable friction modifiers are found in U.S. Pat. No. 3,933,659, which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures thereof; U.S. Pat. No. 3,879,306 which discloses N(hydroxyalkyl)alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. Preferred friction modifiers are succinate esters, or metal salts thereof, of hydrocarbyl substituted succinic acids or anhydrides and thiobis-alkanols such as described in U.S. Pat. No. 4,344,853.

Dispersants maintain oil insolubles, resulting from oxidation during use, in suspension in the fluid, thus preventing sludge flocculation and precipitation or deposition on metal parts. Suitable dispersants include high molecular weight N-substituted alkenyl succinimides, the reaction product of oil-soluble polyisobutylene succinic anhydride with ethylene amines such as tetraethylene pentamine and borated salts thereof. High molecular weight esters (resulting from the esterification of olefin substituted succinic acids with mono or polyhydric aliphatic alcohols) or Mannich bases from high molecular weight alkylated phenols (resulting from the condensation of a high molecular weight alkylsubstituted phenol, an alkylene polyamine and an aldehyde such as formaldehyde) are also useful as dispersants.

Pour point depressants, otherwise known as lube oil flow improvers, lower the temperature at which the fluid will flow or can be poured. Such additives are well known in the art. Typically of those additives which usefully optimize the low temperature fluidity of the fluid are $C_8$-$C_{18}$ dialkylfumarate vinyl acetate copolymers, polymethacrylates, and wax naphthalene.

Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate, which also serves as an antioxidant.

Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz, overbased) metal sales, such as highly basic alkaline earth metal sulfonates (especially Ca and Mg salts) are frequently used as detergents.

Compositions when containing these conventional additives are typically blended into the base oil in amounts which are effective to provide their normal attendant function. Thus, typical formulations can include, in amounts by weight, a VI improver of the present invention (0.01-12%); a corrosion inhibitor (0.01-5%); an oxidation inhibitor (0.01-5%); a dispersant (0.1-20%); a pour point depressant (0.01-5%); an anti-foaming agent (0.001-3%); an anti-wear agent (0.001-5%); a friction modifier (0.01-5%); a detergent/rust inhibitor (0.01-10%); and a base oil.

When other additives are used, it may be desirable, although not necessary, to prepare additive concentrates comprising concentrated solutions or dispersions of the Viscosity Index Improver (in concentrate amounts herein above described), together with one or more of the other additives, such a concentrate denoted an "additive package," whereby several additives can be added simultaneously to the base oil to form a lubricating oil composition. Dissolution of the additive concentrate into the lubricating oil may be facilitated by solvents and by mixing accompanied with mild heating, but this is not essential. The additive package will typically be formulated to contain the Viscosity Index Improver and optional additional additives in proper amounts to provide the desired concentration in the final formulation when the additive package is combined with a predetermined amount of base lubricant. Thus, the products of the present invention can be added to small amounts of base oil or other compatible solvents along with other desirable additives to form additive packages containing active ingredients in collective amounts of typically from 2.5 to 90%, preferably from 5 to 75%, and still more preferably from 8 to 50% by weight additives in the appropriate proportions with the remainder being base oil.

The final formulations may use typically about 10 wt. % of the additive package with the remainder being base oil.

Conventional blending methods are described in U.S. Pat. No. 4,464,493. This conventional process requires passing the polymer through an extruder at elevated temperature for degradation of the polymer and circulating hot oil across the die face of the extruder while reducing the degraded polymer to particle size upon issuance from the extruder and into the hot oil. The OCP's can be added in pellet form where appropriate by blending directly with the base oil so as to make the VI Improver, so that the complex multi-step process of the prior art is not needed. The solid polymer composition can be dissolved in the base oil without the need for additional shearing and degradation processes.

The polymer compositions will be soluble at room temperature in lube oils at up to 15 percent concentration in order to prepare a viscosity modifier concentrate. Such concentrate, including eventually an additional additive package including the typical additives used in lube oil application as described above, is generally further diluted to the final concentration (usually around 1%) by multi-grade lube oil producers. In this case, the concentrate will be a pourable homogeneous solid free solution. The polymer compositions preferably have a Shear Stability Index (SSI) (determined according to ASTM D6278) of from 10 to 50.

EXAMPLES

Figure 2:
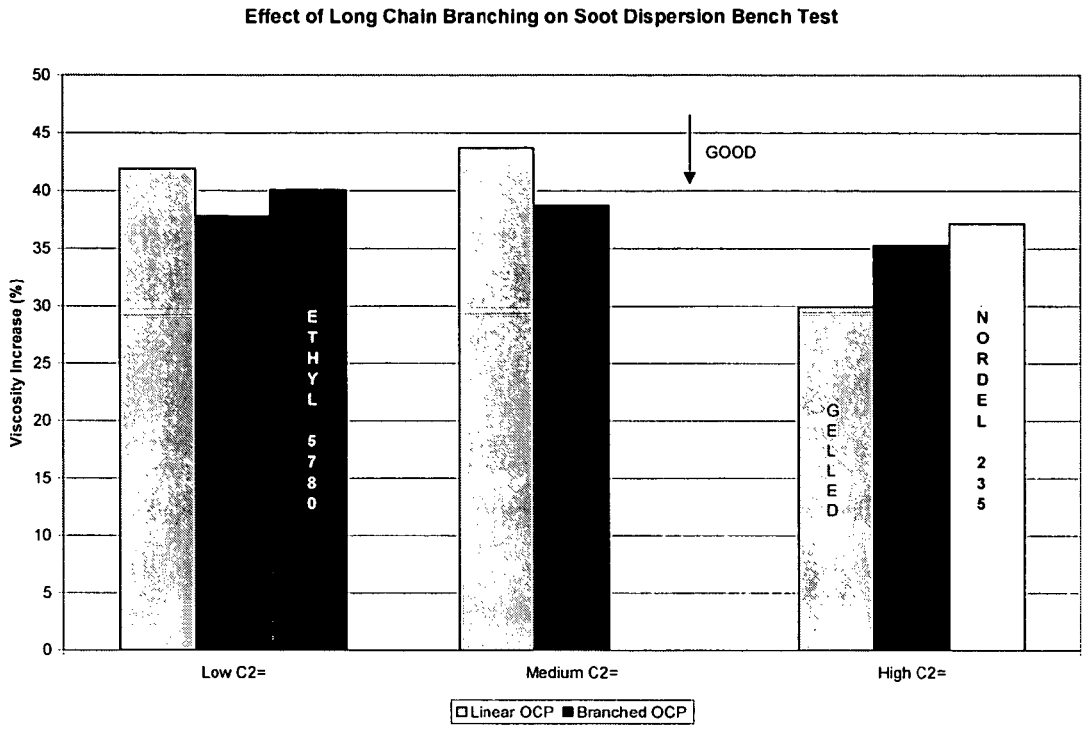
FIG. 2 is a graph of the effe ct of long chain branching of OCR's on the soot dispersion bench test in at least one aspect of the present invention.

Polymerization was carried out in a Continuous Flow Stirred Tank Reactor (CSTR) using a catalyst system using $(p\text{-}Et_3Si\text{-phenyl})_2$ C $(2,7^tBu)_2Flu)(Cp)$ $HfMe_2$ as the transition metal catalyst component and dimethyl anilinium tetrakis (pentafluorophenyl) borate as the activator. The catalyst and activator were pre-mixed in 900 ml of toluene and delivered to the reactor with a metering pump. The production rate was measured by timed collection of a known weight of effluent and measuring the solids concentration by evaporating the solvent. From the catalyst make-up and feed rate and the production rate, the catalyst productivity was calculated as Catalyst Efficiency (g polymer/g catalyst). The degree of LCB was controlled through the choice of reactor temperature and monomer conversion. The composition and either the molecular weight in terms of the melt Index or Mooney Viscosity of the resulting polymer were also measured. Two commercial OCPs, one made with Ziegler-Natta catalyst not having appreciable LCB and one made with the metallocene catalyst were also included in the study. The polymers were formulated in a Group I base stock and subjected to two dispersancy tests. In the first, the increase in radius of a spot of sooted oil containing a VI Improver placed on blotter paper is used as an indicator of dispersancy. The greater this number, the better one would expect soot particles to be dispersed in an automotive engine. In a second test, the viscosity increase due to the addition of soot to an oil containing VI Improver is measured. In this test, a small increase in viscosity is considered better in terms of dispersancy. The polymer data is shown in Table 1 and oil test results in FIGS. 1 and 2 for the blotter spot and soot dispersancy tests respectively. In both tests, the polymers with LCB present having a high MIR or low branching index (BI) performed better.

TABLE 1

| | % C2 | ML (1 + 4@125° C.) | MI | MIR $I_{21}/I_2$ | Mw, GPC Lalls | Mz, GPC Lalls | Mw, GPC DRI | Mn, GPC DRI | g' | BI |
|---|---|---|---|---|---|---|---|---|---|---|
| LCB | 72.9 | 11.3 | 1.58 | 41.4 | 85170 | 136341 | 78403 | 38918 | 0.881 | 0.845 |
| Linear | 77.7 | 8.7 | 2.57 | 14.6 | 89748 | 124073 | 91933 | 51386 | 1.005 | 1.03 |
| LCB | 48.7 | 2.5 | 18.5 | NM | 60830 | 106756 | 61508 | 29004 | 0.917 | 0.872 |
| Linear | 45.6 | 11.3 | 2.16 | 15.6 | 119687 | 170622 | 122770 | 67092 | 1.004 | 1.018 |
| LCB | 66.8 | 10.0 | 2.39 | 34.8 | 82701 | 136410 | 80571 | 39649 | 0.92 | 0.89 |
| Linear | 63.8 | 8.0 | 3.37 | 19.8 | 89147 | 135966 | 88399 | 47336 | 0.981 | 0.974 |

All documents cited herein are fully incorporated by reference for all jurisdictions in which such incorporation is permitted and to the extent they are not inconsistent with this specification.

The invention claimed is:

1. A crankcase lube formulation comprising an ethylene alpha-olefin copolymer ("OCP") comprising a copolymer of ethylene and propylene having from 40 to 80 wt % of ethylene derived units and an ML (1+4@125° C.) of from 2 to 30 and an Mw/Mn (GPC, DRI) of from 1.8 to 2.5 and an $I_{21}/I_2$ of 20 to 400, wherein the OCP contains no diene derived units.

2. A formulation according to claim 1 wherein the OCP reactivity ratio is less than 1.

3. A formulation according to claim 1 wherein the $I_{21}/I_2$ is from 30 to 60.

4. A crankcase lube formulation comprising an ethylene alpha-olefin copolymer ("OCP") comprising a copolymer of ethylene and propylene having from 40 to 80 wt % of ethylene derived units and an ML (1+4@125° C.) of from 2 to 30 and an Mw/Mn (GPC, DRI) of from 1.8 to 2.5 and an $I_{21}/I_2$ of 20 to 400, wherein the OCP has a bimodal composition distribution.

5. A formulation according to claim 1 wherein the OCP is not grafted.

6. A formulation according to claim 1 wherein the OCP is grafted with a functionalizing reagent such as maleic anhydride and optionally an amine.

7. A formulation according to claim 1 wherein the OCP has a Branching Index from 0.5 to 0.9.

8. A formulation according to claim 1 wherein the OCP has a Branching Index from 0.7 to 0.9.

* * * * *